US008807064B2

(12) United States Patent
Yang

(10) Patent No.: US 8,807,064 B2
(45) Date of Patent: Aug. 19, 2014

(54) DETACHABLE STAND AND SCOREBOARD ASSEMBLY HAVING THE SAME

(75) Inventor: Chui-Ching Yang, New Taipei (TW)

(73) Assignee: Chuang Yii Enterprise Co., Ltd., New Taipei (TW)

( * ) Notice: Subject to any disclaimer, the term of this patent is extended or adjusted under 35 U.S.C. 154(b) by 354 days.

(21) Appl. No.: 13/328,433

(22) Filed: Dec. 16, 2011

(65) Prior Publication Data

US 2013/0152849 A1 Jun. 20, 2013

(51) Int. Cl.

*A63B 71/06* (2006.01)
*F16M 11/04* (2006.01)
*G09F 11/00* (2006.01)

(52) U.S. Cl.

USPC ..... 116/223; 116/222; 248/125.8

(58) Field of Classification Search

CPC ..... A63B 71/06; A63B 71/0672; A63F 1/18; A63F 2009/0035; F16M 11/04; F16M 11/26; G09F 11/00; G09F 11/06; G09F 11/08

USPC ..... 116/222, 223, 224, 225; 40/536, 40/606.01, 606.03, 606.14, 607.1, 617; 211/58; 235/1 B; 248/125.8, 125.9, 248/529; D10/46.1

See application file for complete search history.

(56) References Cited

U.S. PATENT DOCUMENTS

| | | | | | |
|---|---|---|---|---|---|
| 2,430,840 | A | * | 11/1947 | Westfall | 248/529 |
| 3,220,127 | A | * | 11/1965 | Wilson | 40/388 |
| 3,545,112 | A | * | 12/1970 | Pershing et al. | 40/536 |
| 4,807,837 | A | * | 2/1989 | Gawlik et al. | 248/125.8 |
| 4,831,956 | A | * | 5/1989 | Thater | 116/222 |
| 5,050,830 | A | * | 9/1991 | Hall | 248/205.2 |
| 5,755,646 | A | * | 5/1998 | Chu | 482/118 |
| 6,041,934 | A | * | 3/2000 | Alexson | 206/579 |
| 6,644,601 | B2 | * | 11/2003 | Aussiker | 248/49 |
| 6,983,915 | B2 | * | 1/2006 | Adelman | 248/125.8 |
| 7,107,714 | B2 | * | 9/2006 | Evans et al. | 40/610 |
| 7,213,361 | B1 | * | 5/2007 | Perigo, Sr. | 43/21.2 |
| 7,806,381 | B2 | * | 10/2010 | Sisk Horne et al. | 248/354.5 |
| D644,131 | S | * | 8/2011 | Karu | D10/46.1 |
| 8,272,602 | B2 | * | 9/2012 | Ye | 248/122.1 |
| 2004/0214665 | A1 | * | 10/2004 | Kane et al. | 473/433 |
| 2009/0094889 | A1 | * | 4/2009 | Felling | 47/39 |
| 2012/0036751 | A1 | * | 2/2012 | Wang et al. | 40/600 |
| 2012/0061531 | A1 | * | 3/2012 | Ho | 248/125.8 |

FOREIGN PATENT DOCUMENTS

| | | | | | |
|---|---|---|---|---|---|
| CH | 612589 | A | * | 8/1979 | A63B 71/06 |
| DE | 4120501 | C1 | * | 7/1992 | A47B 19/08 |
| JP | 2005312865 | A | * | 11/2005 | A63B 71/06 |
| JP | 2007021070 | A | * | 2/2007 | A63B 71/06 |
| JP | 3140255 | U | * | 3/2008 | A63B 71/06 |
| JP | 3163223 | U | * | 10/2010 | A63B 71/06 |
| KR | 442658 | Y1 | * | 12/2008 | A63B 71/06 |
| TW | M251631 | U | | 12/2004 | |

* cited by examiner

*Primary Examiner* — R. A. Smith

(74) *Attorney, Agent, or Firm* — C. G. Mersereau; Nikolai & Mersereau, P.A.

(57) ABSTRACT

A scoreboard assembly has a scoreboard, a storage box and a detachable stand. The scoreboard includes a folding board. The storage box is detachably connected to the scoreboard. The stand is detachably connected to the scoreboard and is detachable into a top board, a telescopic column, a joint and at least three legs. The telescopic column is detachably connected to the top board. The joint is detachably connected to the telescopic column. The legs are detachably connected to the joint. When the scoreboard assembly is in use, the stand is assembled and the scoreboard is elevated by the stand, which allows players and spectators to watch the score displayed on the scoreboard easily. When the scoreboard assembly is not in use, the stand is disassembled for storage in the storage box and the folding board of the scoreboard is folded to cover the storage box for portability.

17 Claims, 12 Drawing Sheets

DETACHABLE STAND AND SCOREBOARD ASSEMBLY HAVING THE SAME

BACKGROUND OF THE UTILITY MODEL

1. Field of the Utility Model

The present utility model relates to a scoreboard, and more particularly to a scoreboard assembly having a detachable stand that is convenient for use and carrying.

2. Description of the Prior Arts

A scoreboard is a board for displaying the score to the public during a game. With reference to FIG. 12, a conventional scoreboard comprises a base 90 being triangular in cross section and including a top and multiple rings 91. The rings 91 are mounted on the top of the triangular base 90 for holding numeral cards 70. When a point is made during a game, a scorekeeper will turn the numeral cards 70 to the appropriate digits so as to display the score. However, the triangular base 90 is relatively bulky so that it is inconvenient to carry and store. Besides, the numeral cards 70 are unchangeable, which results in that the conventional scoreboard can only be used in a specific kind of game.

Another conventional scoreboard disclosed in Taiwan Patent No. M251631 comprises a folding board and a ring set. The folding board may be folded into a triangular shape or a rectangular shape. The ring set is mounted on the folding board and includes multiple rings. The rings can be opened for allowing numeral cards to be placed thereon and then the ring can be closed for holding the numeral cards. When the scoreboard is in use, the folding board is folded into the triangular shape. When the scoreboard is not in use, the folding board is reversely folded into the rectangular shape, and thus the space taken up by the folding board can be reduced so as to facilitate carrying and storage of the scoreboard. Besides, the numeral cards are changeable so that the scoreboard can be used in different kinds of games.

However, both the above scoreboards are placed on the ground or a table when in use. The scoreboard placed on the ground does not allow players and spectators to watch the score displayed on the scoreboard easily because the position of the scoreboard is too low. The scoreboard placed on the table is elevated so as to allow players and spectators to watch the score easily, but the table is relatively heavy and is not easily moved from place to place.

To overcome the shortcomings, the present utility model provides a scoreboard assembly having a detachable stand to mitigate or obviate the aforementioned problems.

SUMMARY OF THE UTILITY MODEL

The main object of the present utility model is to provide a scoreboard assembly having a detachable stand that is convenient for use and carrying.

To achieve the foregoing objective, the scoreboard assembly in accordance with the present utility model comprises a scoreboard, a storage box and a detachable stand. The scoreboard includes a folding board and a ring set. The ring set is mounted on the folding board and has multiple rings for holding numeral cards. The storage box is detachably held by the scoreboard and includes a connecting sheet and multiple holes. The connecting sheet is formed on the storage box. The holes are formed through the connecting sheet and correspond to the rings of the ring set. The storage box is held by means of the rings of the ring set passing through the holes in the connecting sheet. The stand is detachably connected to the scoreboard and is detachable into a top board, a telescopic column, a joint and at least three legs. The top board is receivable in the storage box and has two clamps. The two clamps are respectively mounted on two ends of the top board for clamping the scoreboard. The telescopic column is detachably connected to the top board and has a series of tubes. Each tube of the series of tubes is receivable in the storage box. The joint is detachably connected to the telescopic column and is receivable in the storage box. The legs are detachably connected to the joint and are receivable in the storage box. When the scoreboard assembly is in use, the stand is assembled and the folding board is folded into a triangular shape and is elevated by the stand, which allows players and spectators to watch the score displayed on the scoreboard easily. When the scoreboard assembly is not in use, the stand is disassembled for storage in the storage box and the folding board is folded into a rectangular shape and covers the storage box for portability.

Other objectives, advantages and novel features of the utility model will become more apparent from the following detailed description when taken in conjunction with the accompanying drawings.

DETAILED DESCRIPTION OF THE PREFERRED EMBODIMENTS

Figure 1:
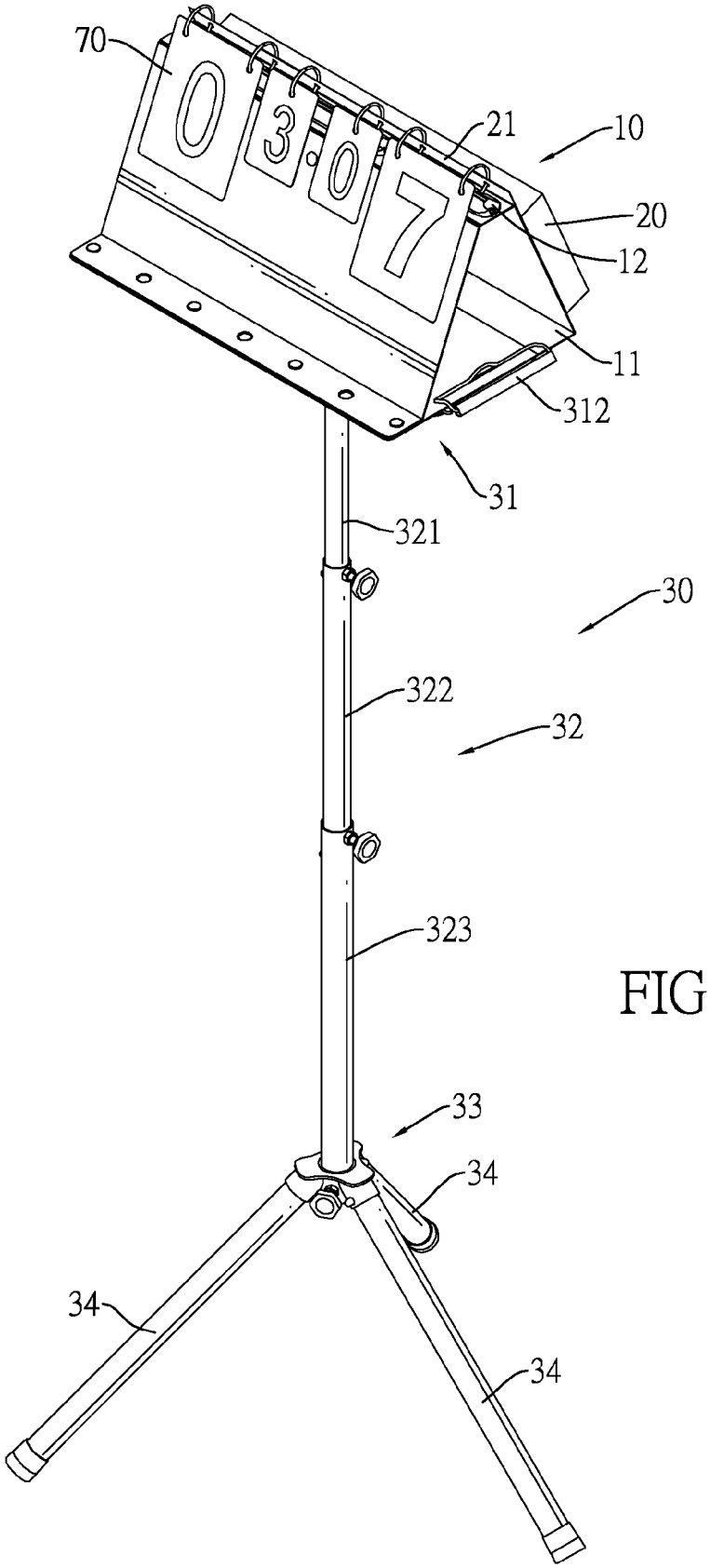
FIG. 1 is a perspective view of a scoreboard assembly in accordance with the present utility model.

With reference to FIG. 1, a scoreboard assembly in accordance with the present utility model comprises a scoreboard 10, a storage box 20 and a detachable stand 30.

Figure 9:
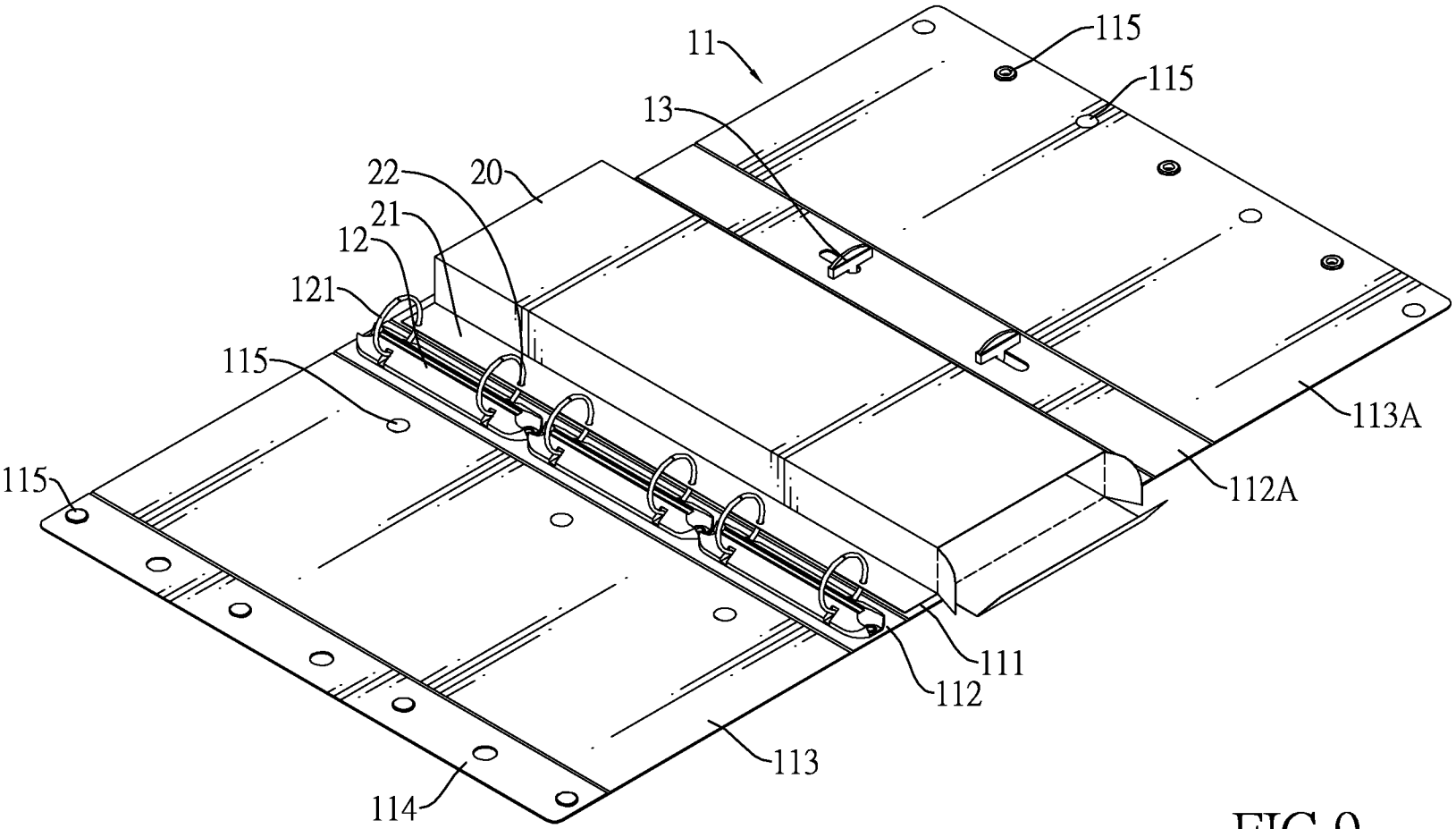
FIG. 9 is an enlarged perspective view of a scoreboard and a storage box of the scoreboard assembly in FIG. 1 showing that a folding board of the scoreboard is unfolded.
Figure 11:
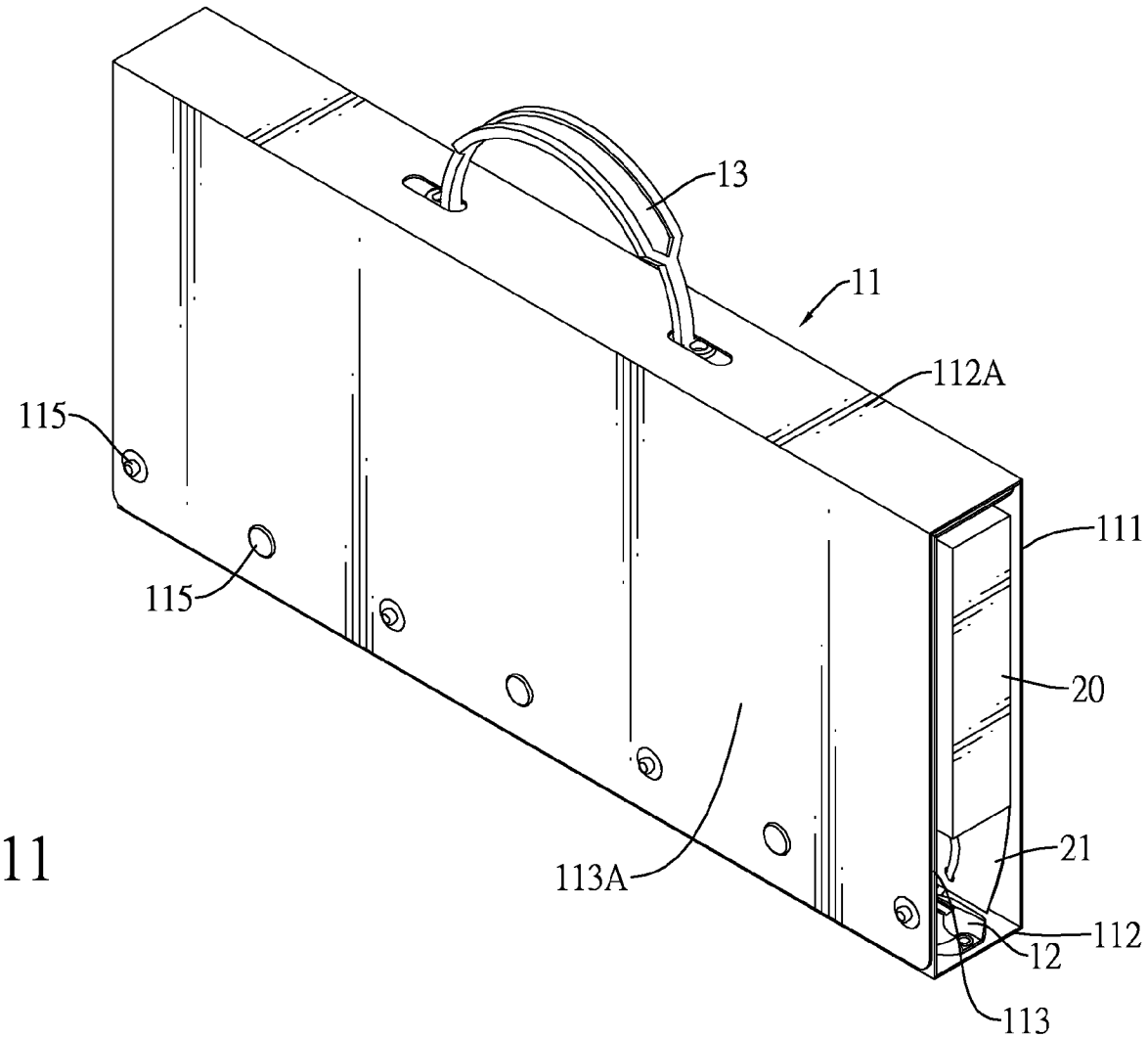
FIG. 11 is an enlarged perspective view of the scoreboard and the storage box of the scoreboard assembly in FIG. 1 showing that the folding board of the scoreboard is folded into a rectangular shape.
Figure 12:
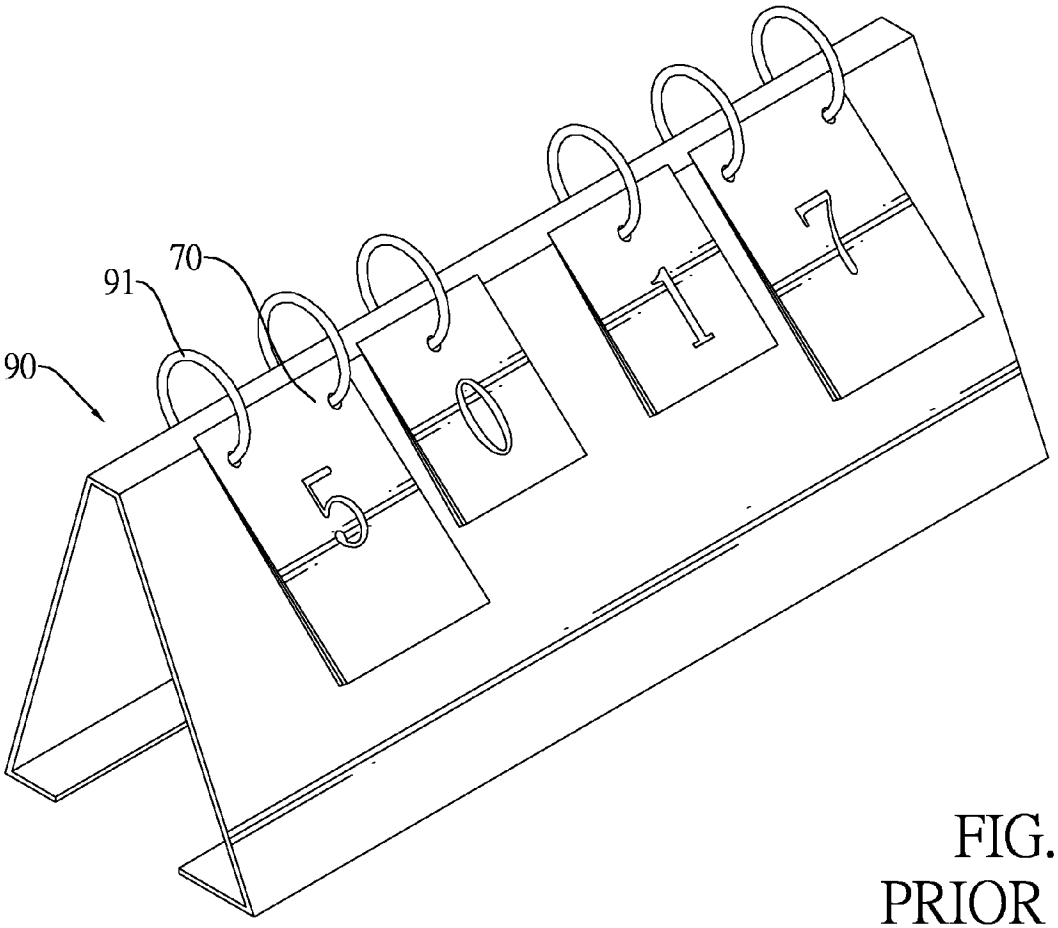
FIG.12 PRIOR ART
FIG. 12 is a perspective view of a conventional scoreboard in accordance with the prior art.

With reference to FIG. 9, the scoreboard 10 is conventional and includes a folding board 11, a ring set 12 and a carrying strap 13. The folding board 11 is foldable into a triangular shape or a rectangular shape and has multiple parallel fold lines so as to form, in sequence, a buckle board 114, a first sideboard 113, a first ridge board 112, a centerboard 111, a second ridge board 112A and a second sideboard 113A. The buckle board 114 has buckles 115 mounted thereon. The first sideboard 113 has buckles 115 mounted thereon. The first ridge board 112 has a width. The centerboard 111 has a length and a width. The second ridge board 112A has a width. The second sideboard 113A has buckles 115 mounted thereon. Some of the buckles 115 on the second sideboard 113A are able to engage the buckles 115 on the buckle board 114 when the folding board 11 is folded into the triangular shape and some of the buckles 115 on the second sideboard 113A are able to engage the buckles 115 on the first sideboard 113 when the folding board 11 is folded into the rectangular shape as shown in FIG. 11. The ring set 12 is mounted on the first ridge board 112 of the folding board 11 and has multiple rings 121 for detachably holding numeral cards 70. The carrying strap 13 is attached to the second ridge board 112A of the folding board 11 for easy carrying.

The storage box 20 is detachably held by the scoreboard 10 and includes a length, a width, a height, a connecting sheet 21 and multiple holes 22. The length of the storage box 20 is less than the length of the centerboard 111 of the folding board 11. The width of the storage box 20 is less than the width of the centerboard 111 of the folding board 11. The height of the storage box 20 is less than the widths of the first and second ridge boards 112,112A of the folding board 11. The connecting sheet 21 is formed on the storage box 20. The holes 22 are formed through the connecting sheet 21 and correspond to the rings 121 of the ring set 12. The storage box 20 is held by means of the rings 121 of the ring set 12 running through the holes 22 in the connecting sheet 21.

Figure 2:
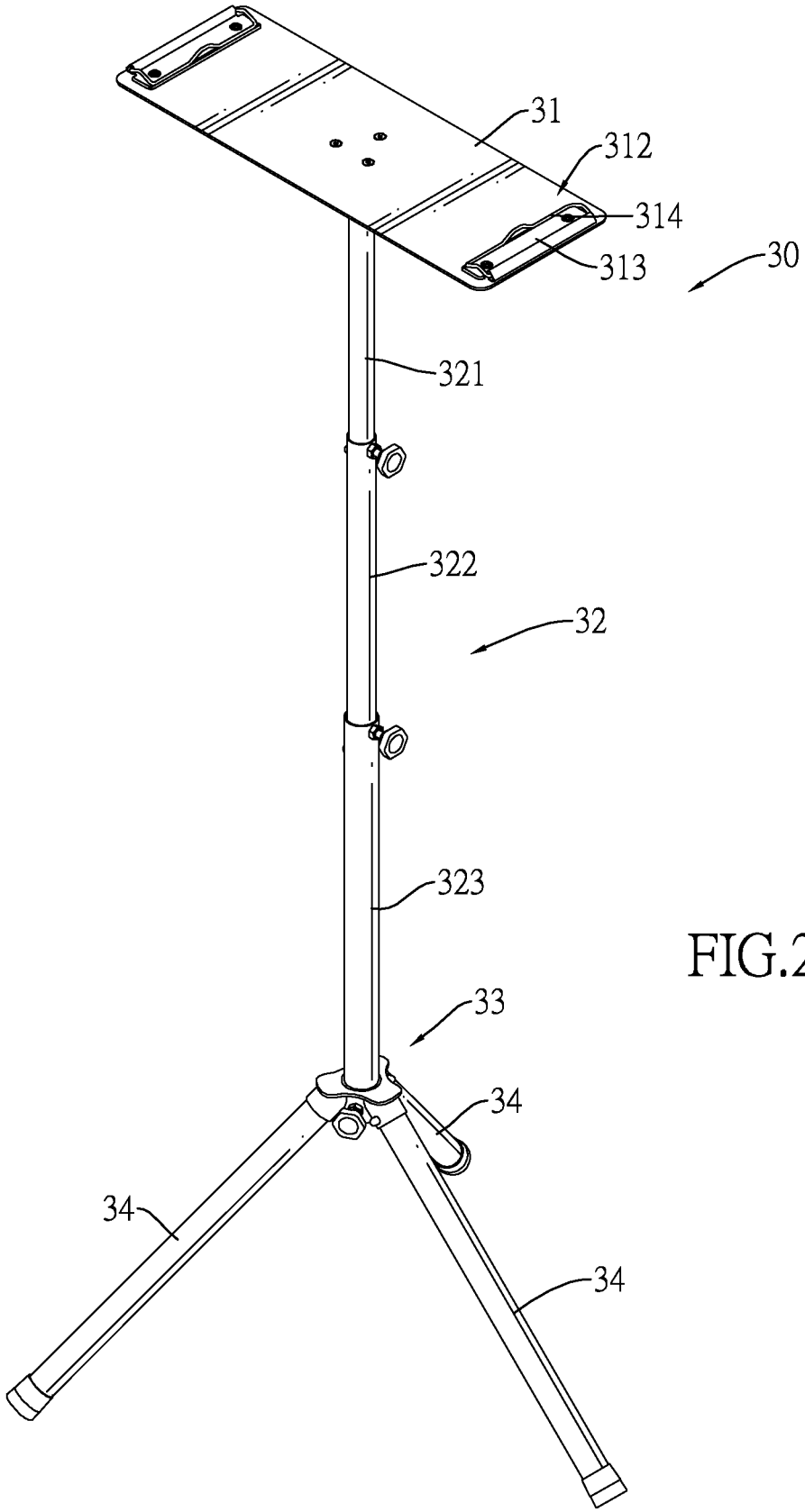
FIG. 2 is a top perspective view of a stand of the scoreboard assembly in FIG. 1.
Figure 3:
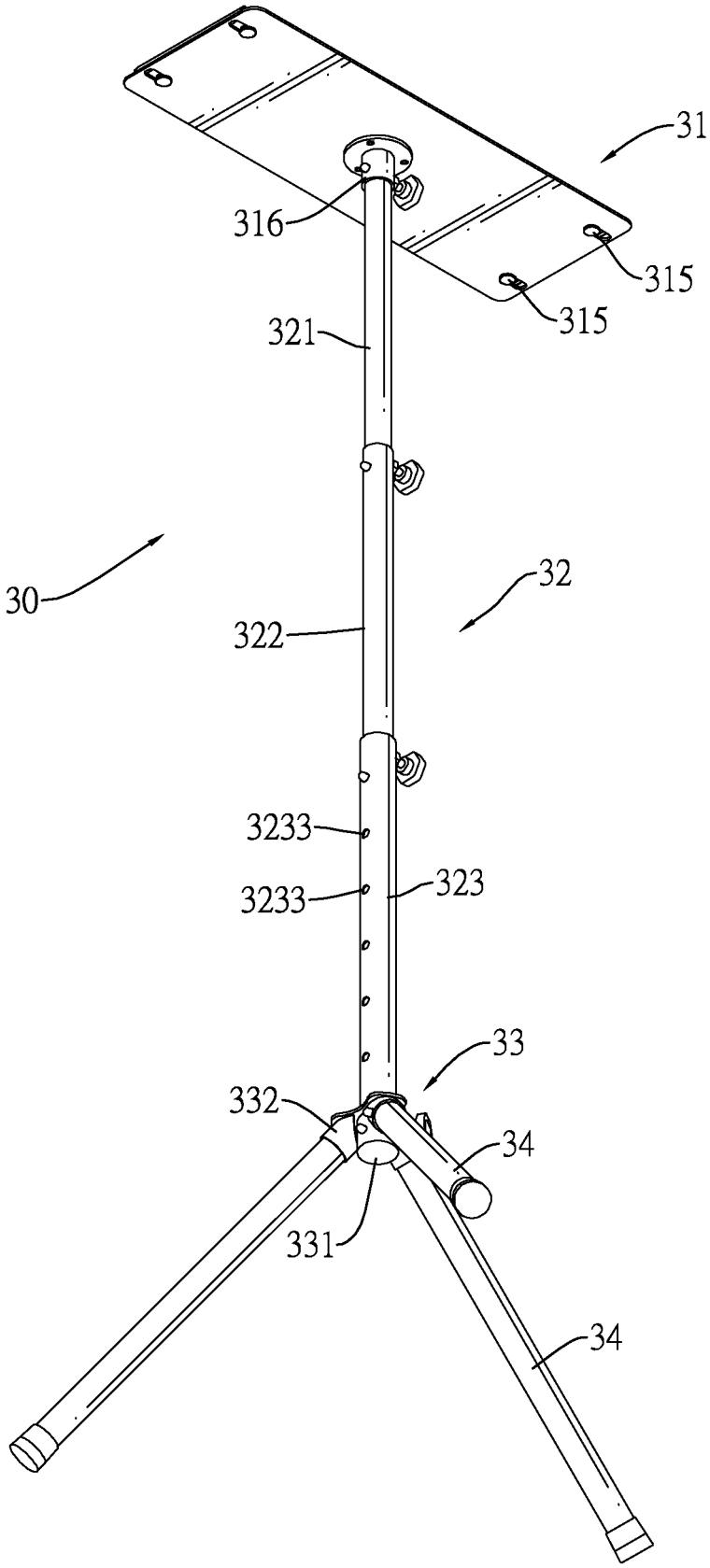
FIG. 3 is a bottom perspective view of the stand of the scoreboard assembly in FIG. 1.
Figure 4:
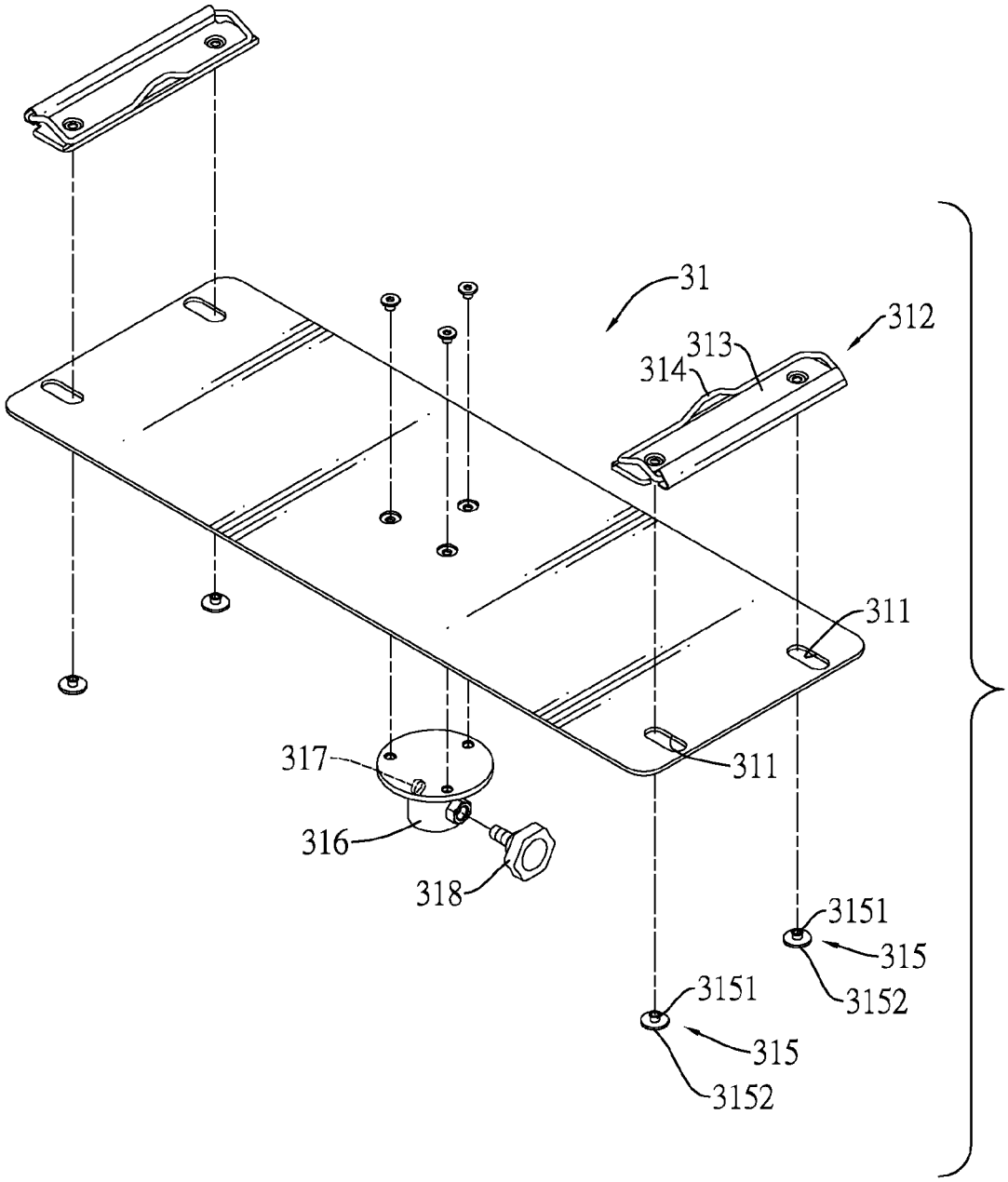
FIG. 4 is an enlarged exploded perspective view of a top board of the stand of the scoreboard assembly in FIG. 1.

With reference to FIGS. 2 and 3, the stand 30 is detachably connected to the scoreboard 10 and is detachable into a top board 31, a telescopic column 32, a joint 33 and at least three legs 34. With further reference to FIG. 4, the top board 31 is receivable in the storage box 20 and has a length, a width, two ends, a center, a lower surface, two groups of two guide slots 311, two clamps 312 and a connecting sleeve 316. The length of the top board 31 is less than the length of the storage box 20. The width of the top board 31 is less than the width of the storage box 20. The two groups of the guide slots 311 are respectively formed through the two ends of the top board 31. The guide slots 311 of each group are parallel to each other and parallel to the length of the top board 31. The two clamps 312 are respectively mounted on the two ends of the top board 31 and are slidable along the guide slots 311 for clamping the second sideboard 113A of the folding board 11. Each clamp 312 has a mounting board 313, a clamping bar 314 and two rivets 315. The mounting board 313 is slidably mounted on the top board 31. The clamping bar 314 is mounted on the mounting board 313. Each rivet 315 includes a shaft 3151 with a head 3152 on one end. The shaft 3151 is slidably mounted through a corresponding guide slot 311 from a bottom of the top board 31 and secured to the mounting board 313 and the head 3152 is positioned under the top board 31 so as to make the clamp 312 slidably mounted on the top board 31. The connecting sleeve 316 is secured to the center and the lower surface of the top board 31 and has a positioning hole 317 and a bolt 318. The positioning hole 317 is formed through the connecting sleeve 316. The bolt 318 passes through the connecting sleeve 316 and is opposite the positioning hole 317.

Figure 5:
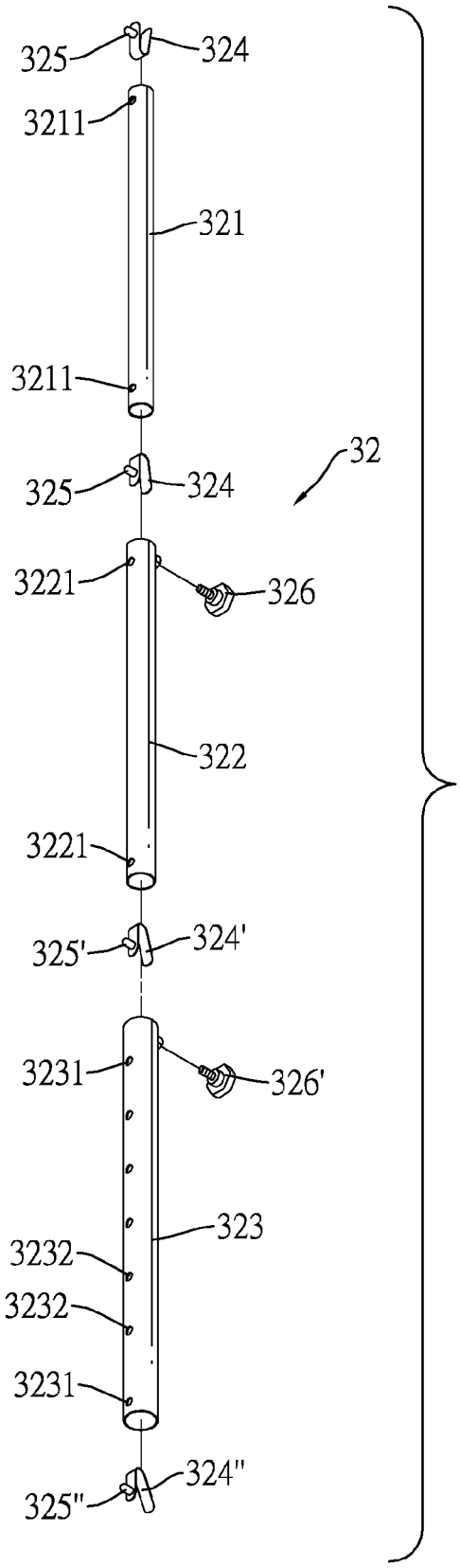
FIG. 5 is an exploded perspective view of a telescopic column of the stand of the scoreboard assembly in FIG. 1.

With further reference to FIG. 5, the telescopic column 32 is detachably connected to the top board 31 and has a top end, a bottom end and a series of tubes of progressively smaller diameters nested within each other. The top end of the telescopic column 32 is inserted in the connecting sleeve 316 of the top board 31. Each tube of the series of tubes is hollow, is receivable in the storage box 20 and has a length being less than the length of the storage box 20. The series of tubes has a top tube 321, a middle tube 322 and a bottom tube 323. The top tube 321 is detachably connected to the connecting sleeve 316 of the top board 31 and has a top end, a bottom end, two positioning holes 3211 and two spring elements 324. The positioning holes 3211 are respectively formed through the top and bottom ends of the top tube 321. The spring elements 324 are mounted respectively in the top and bottom ends of the top tube 321. Each spring element 324 is U-shaped and has a locking protrusion 325 attached thereto and extending through one of the positioning holes 3211 of the top tube 321. The top tube 321 is connected to the connecting sleeve 316 by means that the top end of the top tube 321 is inserted in the connecting sleeve 316 to make the locking protrusion 325 of the spring element 324 of the top end of the top tube 321 correspond to and extend through the positioning hole 317 of the connecting sleeve 316. The bolt 318 of the connecting sleeve 316 can then be fastened to abut the top tube 321 so as to secure the connecting sleeve 316 to the top tube 321.

The middle tube 322 is detachably connected to the top tube 321 and has a top end, a bottom end, two positioning holes 3221, a spring element 324' and a bolt 326. The positioning holes 3221 are respectively formed through the top and bottom ends of the middle tube 322. The spring element 324' is mounted in the bottom end of the middle tube 322. The spring element 324' may be a spring plate, is U-shaped and has a locking protrusion 325' attached thereto and extending through the positioning hole 3221 of the bottom end of the middle tube 322. The bolt 326 passes through the middle tube 322 and is opposite the positioning hole 3221 of the top end of the middle tube 322. The middle tube 322 is connected to the top tube 321 by means that the bottom end of the top tube 321 is inserted in the top end of the middle tube 322 to make the locking protrusion 325 of the spring element 324 of the bottom end of the top tube 321 correspond to and extend through the positioning hole 3221 of the top end of the middle tube 322. The bolt 326 of the middle tube 322 can then be fastened to abut the top tube 321 so as to secure the middle tube 322 to the top tube 321.

The bottom tube 323 is detachably connected to the middle tube 322 and has a top end, a bottom end, two positioning holes 3231, a spring element 324" and a bolt 326'. The positioning holes 3231 are respectively formed through the top and bottom ends of the bottom tube 323. The spring element 324" is mounted in the bottom end of the bottom tube 323. The spring element 324" is U-shaped and has a locking protrusion 325" attached thereto and extending through the positioning hole 3231 of the bottom end of the bottom tube 323. The bolt 326' passes through the bottom tube 323 and is opposite the positioning hole 3231 of the top end of the bottom tube 323. The bottom tube 323 is connected to the middle tube 322 by means that the bottom end of the middle tube 322 is inserted in the top end of the bottom tube 323 to make the locking protrusion 325' of the spring element 324' of the middle tube 322 correspond to and extend through the positioning hole 3231 of the top end of the bottom tube 323. The bolt 326' of the bottom tube 323 can then be fastened to abut the middle tube 322 so as to secure the bottom tube 323 to the middle tube 322. The bottom tube 323 may further have multiple positioning holes 3232 formed therethrough and arranged longitudinally. Thereby, the middle tube 322 can be moved along the bottom tube 323 to adjust to a suitable height and the locking protrusion 325' of the spring element 324' of the middle tube 322 can then extend through a corresponding positioning hole 3231,3232 to hold the middle tube 322 at the suitable height.

Figure 6:
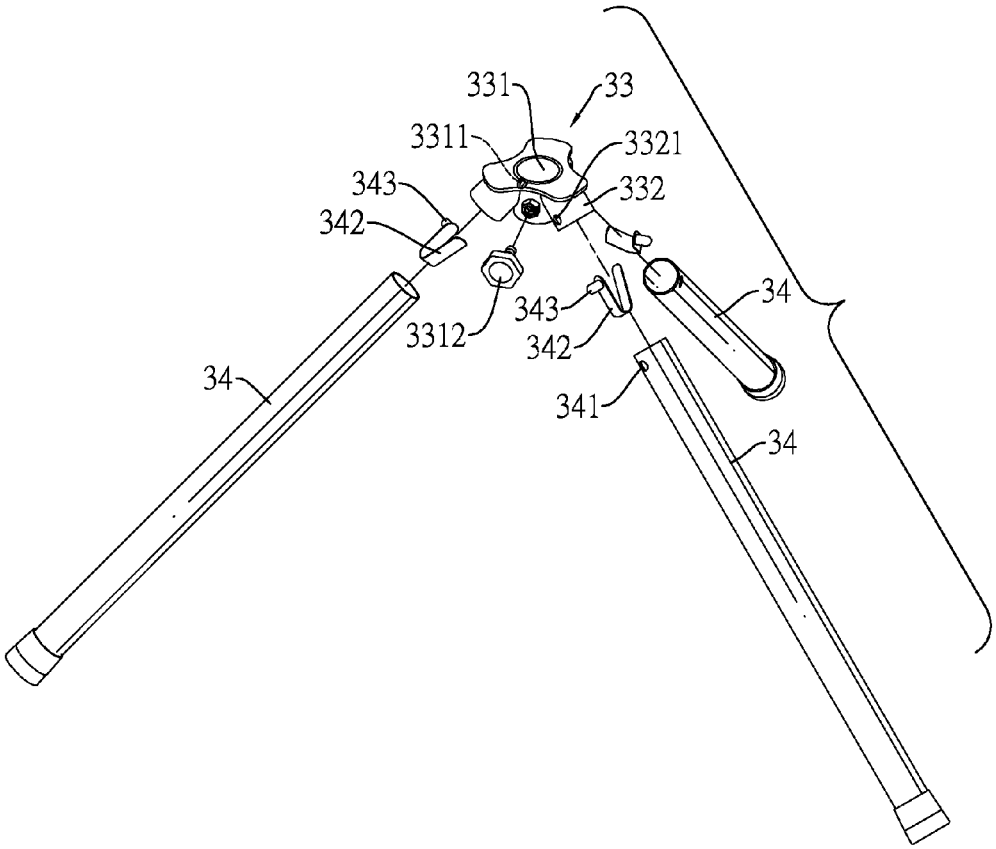
FIG. 6 is an enlarged exploded perspective view of a joint and legs of the stand of the scoreboard assembly in FIG. 1.

With further reference to FIG. 6, the joint 33 is detachably connected to the bottom end of the telescopic column 32, is receivable in the storage box 20 and has a height, a center sleeve 331 and at least three side sleeves 332. The height of the joint 33 is less than the height of the storage box 20. The center sleeve 331 is detachably connected to the bottom tube 323 and has a positioning hole 3311 and a bolt 3312. The positioning hole 3311 is formed through the center sleeve 331. The bolt 3312 passes through the center sleeve 331. The joint 33 is connected to the bottom tube 323 by means that the bottom end of the bottom tube 323 is inserted in the center sleeve 331 to make the locking protrusion 325" of the spring element 324" of the bottom tube 323 correspond to and extend through the positioning hole 3311 of the center sleeve 331. The bolt 3312 of the center sleeve 331 can then be fastened to abut the bottom tube 323 so as to secure the joint 33 to the bottom tube 323. The side sleeves 332 are mounted around and are inclined relative to the center sleeve 331 and each side sleeve 332 has a positioning hole 3321 formed therethrough.

The legs 34 are detachably connected to the joint 33. Each leg 34 is hollow, corresponds to and is detachably connected to one of the side sleeves 332 of the joint 33, is receivable in the storage box 20 and has a length, a top end, a positioning hole 341 and a spring element 342. The length of the leg 34 is less than the length of the storage box 20. The positioning hole 341 is formed through the top end of the leg 34. The spring element 342 is mounted in the top end of the leg 34. The spring element 342 is U-shaped and has a locking protrusion 343 attached thereto and extending through the positioning hole 341 of the leg 34. The leg 34 is connected to the corresponding side sleeve 332 of the joint 33 by means that the top end of the leg 34 is inserted in the side sleeve 332 to make the locking protrusion 343 of the spring element 342 of the leg 34 correspond to and extend through the positioning hole 3321 of the side sleeve 332.

Figure 7:
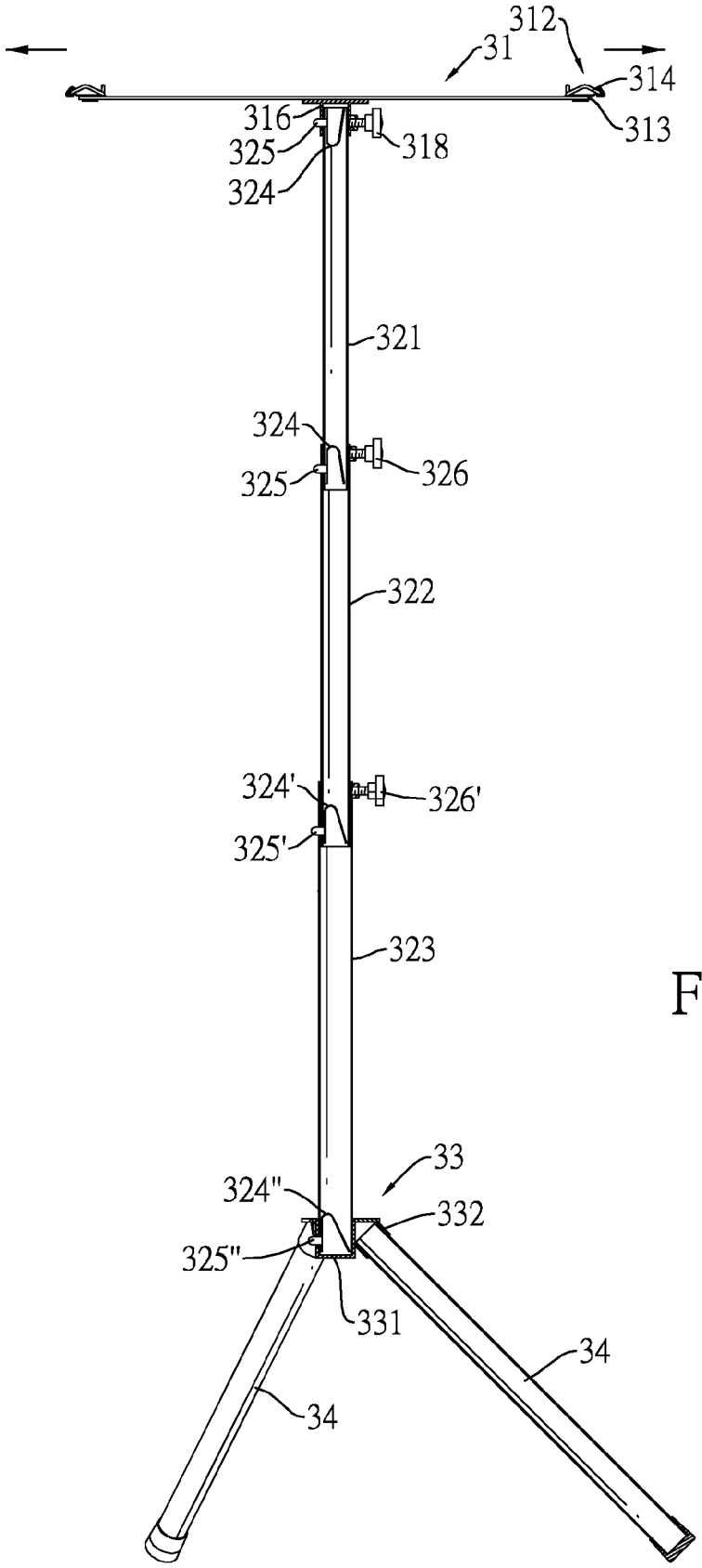
FIG. 7 is a side view in partial section of the stand of the scoreboard assembly in FIG. 1.

With reference to FIGS. 1 and 7, when the scoreboard assembly is in use, the stand 30 is assembled and the two clamps 312 on the top board 31 are pulled along the guide slots 311 away from each other, the folding board 11 folded into the triangular shape can then be placed on the top board 31 and clamped by the clamps 312. Therefore, the scoreboard 10 is elevated by the stand 30 that allows players and spectators to watch the score displayed on the scoreboard 10 easily and no table is required for elevating the scoreboard 10.

Figure 8:
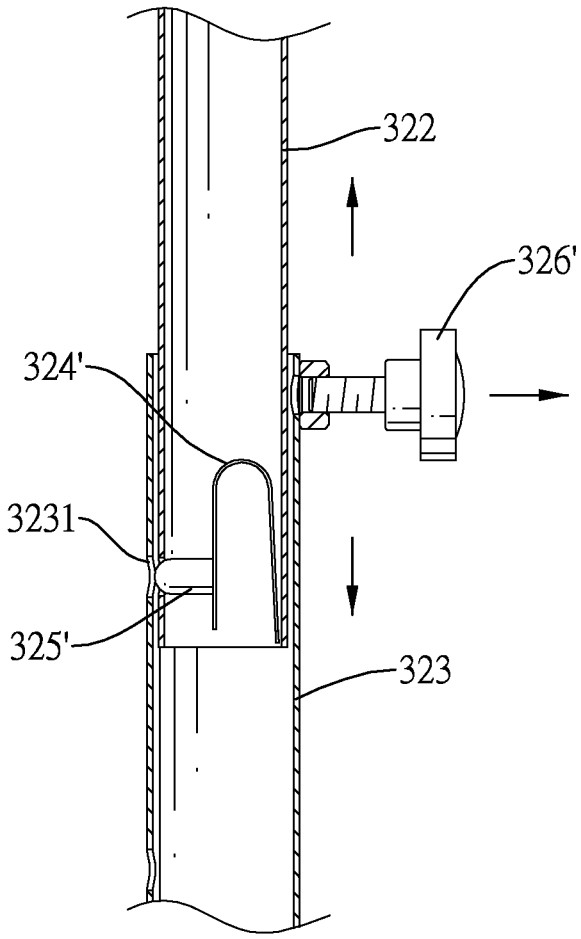
FIG. 8 is a partial enlarged view of the stand of the scoreboard assembly in FIG. 7.
Figure 10:
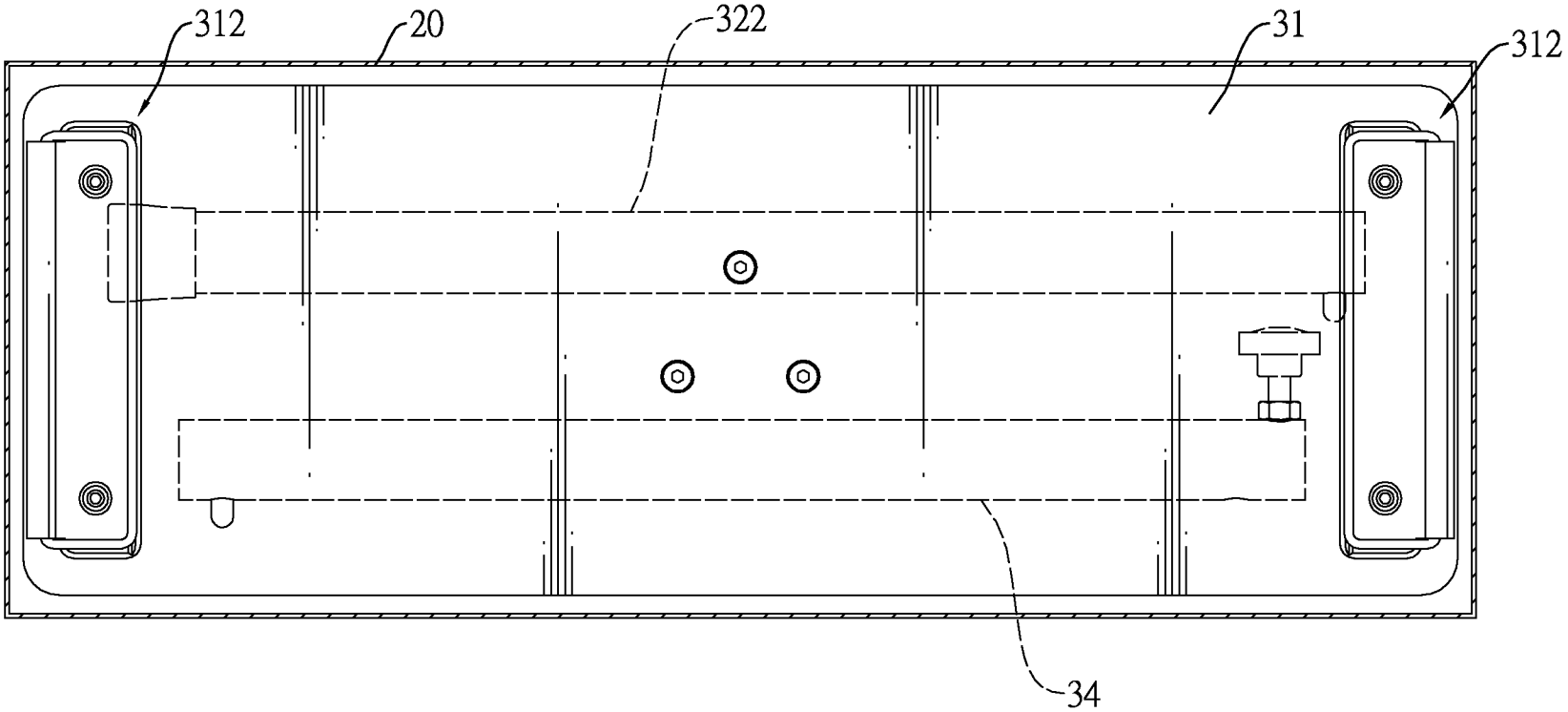
FIG. 10 is an enlarged top view in partial section of the storage box of the scoreboard assembly in FIG. 1 showing that the top board, the telescopic column and the leg are stored in the storage box.

With further reference to FIGS. 10 and 11, when the scoreboard assembly is not in use, the stand 30 is disassembled for storage in the storage box 20 and the folding board 11 is folded into the rectangular shape and covers the storage box 20 for portability. The components of the stand 30 are connected to each other by the same structures so that they can be disassembled by the same procedures. For example, with reference to FIG. 8, the middle tube 322 is disassembled from the bottom tube 323. The disassembling procedures are loosening the bolt 326' of the bottom tube 323 first, then pressing the locking protrusion 325' into the middle tube 322 to allow the middle tube 322 to detach from the bottom tube 323.

Even though numerous characteristics and advantages of the present utility model have been set forth in the foregoing description, together with details of the structure and features of the utility model, the disclosure is illustrative only. Changes may be made in the details, especially in matters of shape, size and arrangement of parts within the principles of the utility model to the full extent indicated by the broad general meaning of the terms in which the appended claims are expressed.

What is claimed is:

1. A scoreboard assembly comprising:

a scoreboard including
- a folding board having
  - a buckle board having buckles mounted thereon;
  - a first sideboard having buckles mounted thereon;
  - a first ridge board having a width;
  - a centerboard having a length and a width;
  - a second ridge board having a width; and
  - a second sideboard having buckles mounted thereon, some of the buckles on the second sideboard being able to engage the buckles on the buckle board and some of the buckles on the second sideboard being able to engage the buckles on the first sideboard; and
- a ring set mounted on the first ridge board of the folding board and having multiple rings for detachably holding numeral cards;

a storage box detachably held by the scoreboard and including
- a length being less than the length of the centerboard of the folding board;
- a width being less than the width of the centerboard of the folding board;
- a height being less than the widths of the first and second ridge boards of the folding board;
- a connecting sheet formed on the storage box; and
- multiple holes formed through the connecting sheet and allowing the rings of the ring set to pass therethrough; and a detachable stand detachably connected to the scoreboard, being detachable for storage in the storage box and including
- a top board having
  - a length being less than the length of the storage box;
  - a width being less than the width of the storage box;
  - two ends;
  - a center;
  - a lower surface;
  - two clamps respectively mounted on the two ends of the top board and being slidable along the length of the top board for clamping the second sideboard of the folding board; and
  - a connecting sleeve secured to the center and the lower surface of the top board;
- a telescopic column detachably connected to the top board and having
  - a top end inserted in the connecting sleeve of the top board;
  - a bottom end; and
  - a series of tubes of progressively smaller diameters nested within each other and each tube of the series of tubes having a length being less than the length of the storage box;
- a joint detachably connected to the telescopic column and having
  - a height being less than the height of the storage box;
  - a center sleeve in which the bottom end of the telescopic column is inserted; and
  - at least three side sleeves mounted around and being inclined relative to the center sleeve; and
- at least three legs detachably connected to the joint and each leg corresponding to and detachably connected to one of the side sleeves of the joint and having a length being less than the length of the storage box.

2. The scoreboard assembly as claimed in claim 1, wherein the top board further has two groups of two guide slots and each group of the guide slots is formed through one of the ends of the top board and is parallel to the length of the top board; and each clamp of the top board has a mounting board slidably mounted on the top board;

a clamping bar mounted on the mounting board; and two rivets and each rivet having a shaft slidably mounted through a corresponding guide slot and secured to the mounting board; and a head mounted on one end of the shaft and positioned under the top board.

3. The scoreboard assembly as claimed in claim 2, wherein the connecting sleeve of the top board has a positioning hole formed therethrough;

the series of tubes of the telescopic column has a top tube detachably connected to the top board and having a top end inserted in the connecting sleeve of the top board;

a bottom end;

two positioning holes respectively formed through the top and bottom ends of the top tube; and two spring elements mounted respectively in the top and bottom ends of the top tube and each spring element being U-shaped and having a locking protrusion attached thereto and extending through one of the positioning holes of the top tube, the locking protrusion of the spring element of the top end of the top tube being extendable through the positioning hole of the connecting sleeve of the top board;

a middle tube detachably connected to the top tube and having a top end in which the bottom end of the top tube is inserted;

a bottom end;

two positioning holes respectively formed through the top and bottom ends of the middle tube, the locking protrusion of the spring element of the bottom end of the top tube being extendable through the positioning hole of the top end of the middle tube; and a spring element mounted in the bottom end of the middle tube, being U-shaped and having a locking protrusion attached thereto and extending through the positioning hole of the bottom end of the middle tube; and a bottom tube detachably connected to the middle tube and having a top end in which the bottom end of the middle tube is inserted;

a bottom end;

two positioning holes respectively formed through the top and bottom ends of the bottom tube, the locking protrusion of the spring element of the middle tube being extendable through the positioning hole of the top end of the bottom tube; and a spring element mounted in the bottom end of the bottom tube, being U-shaped and having a locking protrusion attached thereto and extending through the positioning hole of the bottom end of the bottom tube; and the center sleeve of the joint is detachably connected to the bottom tube, allows the bottom end of the bottom tube to be inserted therein and has a positioning hole formed therethrough, and the locking protrusion of the spring element of the bottom tube is extendable through the positioning hole of the center sleeve.

4. The scoreboard assembly as claimed in claim 3, wherein the bottom tube of the telescopic column further has multiple positioning holes formed therethrough and arranged longitudinally so as to allow the locking protrusion of the spring element of the middle tube to selectively extend through a corresponding positioning hole of the bottom tube.

5. The scoreboard assembly as claimed in claim 3, wherein the middle tube of the telescopic column has a bolt passing through the top end thereof and fastened to abut the top tube; and the bottom tube of the telescopic column has a bolt passing through the top end thereof and fastened to abut the middle tube.

6. The scoreboard assembly as claimed in claim 1, wherein the connecting sleeve of the top board has a positioning hole formed therethrough;

the series of tubes of the telescopic column has a top tube detachably connected to the top board and having a top end inserted in the connecting sleeve of the top board;

a bottom end;

two positioning holes respectively formed through the top and bottom ends of the top tube; and two spring elements mounted respectively in the top and bottom ends of the top tube and each spring element being U-shaped and having a locking protrusion attached thereto and extending through one of the positioning holes of the top tube, the locking protrusion of the spring element of the top end of the top tube being extendable through the positioning hole of the connecting sleeve of the top board;

a middle tube detachably connected to the top tube and having a top end in which the bottom end of the top tube is inserted;

a bottom end;

two positioning holes respectively formed through the top and bottom ends of the middle tube, the locking protrusion of the spring element of the bottom end of the top tube being extendable through the positioning hole of the top end of the middle tube; and a spring element mounted in the bottom end of the middle tube, being U-shaped and having a locking protrusion attached thereto and extending through the positioning hole of the bottom end of the middle tube; and a bottom tube detachably connected to the middle tube and having a top end in which the bottom end of the middle tube is inserted;

a bottom end;

two positioning holes respectively formed through the top and bottom ends of the bottom tube, the locking protrusion of the spring element of the middle tube being extendable through the positioning hole of the top end of the bottom tube; and a spring element mounted in the bottom end of the bottom tube, being U-shaped and having a locking protrusion attached thereto and extending through the positioning hole of the bottom end of the bottom tube; and the center sleeve of the joint is detachably connected to the bottom tube, allows the bottom end of the bottom tube to be inserted therein and has a positioning hole formed therethrough, and the locking protrusion of the spring element of the bottom tube is extendable through the positioning hole of the center sleeve.

7. The scoreboard assembly as claimed in claim 6, wherein the bottom tube of the telescopic column further has multiple positioning holes formed therethrough and arranged longitudinally so as to allow the locking protrusion of the spring element of the middle tube to selectively extend through a corresponding positioning hole of the bottom tube.

8. The scoreboard assembly as claimed in claim 7, wherein the middle tube of the telescopic column has a bolt passing through the top end thereof and fastened to abut the top tube; and the bottom tube of the telescopic column has a bolt passing through the top end thereof and fastened to abut the middle tube.

9. The scoreboard assembly as claimed in claim 8, wherein the center sleeve of the joint has a bolt passing therethrough and fastened to abut the bottom tube;

each side sleeve of the joint has a positioning hole formed therethrough; and each leg has a top end inserted in the corresponding side sleeve of the joint;

a positioning hole formed through the top end of the leg; and a spring element mounted in the top end of the leg, being U-shaped and having a locking protrusion attached thereto, extending through the positioning hole of the leg and being extendable through the positioning hole of the corresponding side sleeve.

10. The scoreboard assembly as claimed in claim 9, wherein the scoreboard further includes a carrying strap attached to the second ridge board of the folding board.

11. The scoreboard assembly as claimed in claim 6, wherein the middle tube of the telescopic column has a bolt passing through the top end thereof and fastened to abut the top tube; and the bottom tube of the telescopic column has a bolt passing through the top end thereof and fastened to abut the middle tube.

12. A detachable stand comprising:

a top board having a length;

two ends;

a center;

a lower surface;

two groups of two guide slots, and each group of the guide slots formed through one of the ends of the top board and being parallel to the length of the top board;

two clamps respectively mounted on the two ends of the top board and being slidable along the length of the top board, and each clamp of the top board having a mounting board slidablv mounted on the top board;

a clamping bar mounted on the mounting board; and two rivets, and each rivet having a shaft slidably mounted through a corresponding guide slot and secured to the mounting board; and a head mounted on one end of the shaft and positioned under the top board; and a connecting sleeve secured to the center and the lower surface of the top board;

a telescopic column detachably connected to the top board and having a top end inserted in the connecting sleeve of the top board;

a bottom end; and a series of tubes of progressively smaller diameters nested within each other;

a joint detachably connected to the telescopic column and having a center sleeve in which the bottom end of the telescopic column is inserted; and at least three side sleeves mounted around and being inclined relative to the center sleeve; and at least three legs detachably connected to the joint and each leg corresponding to and detachably connected to one of the side sleeves of the joint.

13. The stand as claimed in claim 12, wherein the connecting sleeve of the top board has a positioning hole formed therethrough;

the series of tubes of the telescopic column has a top tube detachably connected to the top board and having a top end inserted in the connecting sleeve of the top board;

a bottom end;

two positioning holes respectively formed through the top and bottom ends of the top tube; and two spring elements mounted respectively in the top and bottom ends of the top tube and each spring element being U-shaped and having a locking protrusion attached thereto and extending through one of the positioning holes of the top tube, the locking protrusion of the spring element of the top end of the top tube being extendable through the positioning hole of the connecting sleeve of the top board;

a middle tube detachably connected to the top tube and having a top end in which the bottom end of the top tube is inserted;

a bottom end;

two positioning holes respectively formed through the top and bottom ends of the middle tube, the locking protrusion of the spring element of the bottom end of the top tube being extendable through the positioning hole of the top end of the middle tube; and a spring element mounted in the bottom end of the middle tube, being U-shaped and having a locking protrusion attached thereto and extending through the positioning hole of the bottom end of the middle tube; and a bottom tube detachably connected to the middle tube and having a top end in which the bottom end of the middle tube is inserted;

a bottom end;

two positioning holes respectively formed through the top and bottom ends of the bottom tube, the locking protrusion of the spring element of the middle tube being extendable through the positioning hole of the top end of the bottom tube; and a spring element mounted in the bottom end of the bottom tube, being U-shaped and having a locking protrusion attached thereto and extending through the positioning hole of the bottom end of the bottom tube; and the center sleeve of the joint is detachably connected to the bottom tube, allows the bottom end of the bottom tube to be inserted therein and has a positioning hole formed therethrough, and the locking protrusion of the spring element of the bottom tube is extendable through the positioning hole of the center sleeve.

14. The stand as claimed in claim 13, wherein the bottom tube of the telescopic column further has multiple positioning holes formed therethrough and arranged longitudinally so as to allow the locking protrusion of the spring element of the middle tube to selectively extend through a corresponding positioning hole of the bottom tube.

15. The stand as claimed in claim 14, wherein the middle tube of the telescopic column has a bolt passing through the top end thereof and fastened to abut the top tube; and the bottom tube of the telescopic column has a bolt passing through the top end thereof and fastened to abut the middle tube.

16. The stand as claimed in claim 15, wherein the center sleeve of the joint has a bolt passing therethrough and fastened to abut the bottom tube;

each side sleeve of the joint has a positioning hole formed therethrough; and each leg has a top end inserted in the corresponding side sleeve of the joint;

a positioning hole formed through the top end of the leg; and a spring element mounted in the top end of the leg, being U-shaped and having a locking protrusion attached thereto, extending through the positioning hole of the leg and being extendable through the positioning hole of the corresponding side sleeve.

17. The stand as claimed in claim 13, wherein the middle tube of the telescopic column has a bolt passing through the top end thereof and fastened to abut the top tube; and the bottom tube of the telescopic column has a bolt passing through the top end thereof and fastened to abut the middle tube.

* * * * *